United States Patent [19]

Fukushima

[11] 3,950,489

[45] Apr. 13, 1976

[54] CHLORINE TREATMENT OF TITANIFEROUS ORES

[75] Inventor: Seitaro Fukushima, Omiya, Japan

[73] Assignee: Mitsubishi Kinzoku Kabushiki Kaisha, Tokyo, Japan

[22] Filed: Mar. 13, 1974

[21] Appl. No.: 450,853

[30] Foreign Application Priority Data

Mar. 16, 1973 Japan ..... 48-30629

[52] U.S. Cl. ..... 423/74; 423/148; 423/149; 423/610

[51] Int. Cl.[2] ..... C01G 23/04; C01G 49/10

[58] Field of Search ..... 423/74, 148, 149, 86, 610

[56] References Cited

UNITED STATES PATENTS

| | | | |
|---|---|---|---|
| 2,183,365 | 12/1939 | Booge | 423/149 X |
| 2,961,298 | 11/1960 | Tikkanen | 423/86 |
| 3,112,178 | 11/1963 | Judd | 423/86 X |
| 3,291,599 | 12/1966 | Reeves | 423/74 |
| 3,428,427 | 2/1969 | Raicevic | 423/86 |
| 3,446,590 | 5/1969 | Michal et al. | 423/74 |
| 3,457,037 | 6/1969 | Aramendia et al. | 423/86 |
| 3,699,206 | 10/1972 | Dunn, Jr. | 423/74 |
| 3,784,670 | 1/1974 | Yamada et al. | 423/86 |
| 3,803,287 | 4/1974 | Fukushima et al. | 423/74 |

*Primary Examiner*—Edward Stern
*Attorney, Agent, or Firm*—Wenderoth, Lind and Ponack

[57] ABSTRACT

Artificial rutile of high $TiO_2$ grade is produced by chlorine treatment of titaniferous ore such as ilmenite which comprises a combination of (1) a pretreatment step in which the ore is oxidized by roasting at a temperature below the sintering temperature thereof thereby to activate the ore, (2) a chloridization step in which the pretreated ore is subjected to a chlorine treatment in a fluidized bed chloridization furnace thereby to chloridize and remove selectively iron oxides within the ore without the formation of $TiCl_4$, and (3) an aftertreatment step which comprises subjecting the ore to magnetic separation with a magnetic field of at least 20,000 gauses and further treatments thereafter, as necessary, such as a wet table treatment and electrostatic separation at from 5,000 to 30,000 volts.

6 Claims, 3 Drawing Figures

CHLORINE TREATMENT OF TITANIFEROUS ORES

BACKGROUND OF THE INVENTION

This invention relates generally to chlorine treatment of titaniferous ores containing titanium oxide and iron oxides and more particularly to a process for such treatment wherein the iron oxides within a titaniferous ore are removed by selective chloridization, and, with essentially a single chloridizing treatment, artificial rutile is economically produced as the ultimate objective product.

More specifically, the invention relates to a process for chlorine treatment of titaniferous ores which comprises a combination of a chloridization step wherein iron oxides in the titaniferous ore are selectively chloridized and removed through the use of a fluidized bed type chloridization furnace with a pretreatment step wherein the ore is heated and thereby activated and an after-treatment step wherein the chlorides, solid carbon, and gangue minerals in the ore taken out of the chloridization furnace are separated, and the $TiO_2$ grade is elevated with the aim of ultimately producing artificial rutile of a $TiO_2$ grade of at least 95 percent with essentially one cycle of treatment.

The term "titaniferous ore" as herein used is used to designate an ore which contains titanium dioxide, ferrous and ferric oxides, and a small quantity of coexisting substances, and which can be typically represented by ilmenite.

The method of enriching the titanium dioxide of a titaniferous ore by selectively chloridizing and thereby removing the iron oxides within the ore in a reducing atmosphere is known. For example, the specification of Australian Pat. No. 206,305 discloses a process which comprises continuously supplying a titanium-containing iron-oxide ore into a fluidized bed type chloridization furnace maintained at from 800° to 950° C, causing a selective reaction with iron oxides by means of carbon monoxide and chlorine thereby to remove volatile $FeCl_3$, and continuously taking out the ore in a state wherein less than 8 percent, preferably from 1 to 5 percent, of iron oxides are remaining therein from the chloridization furnace.

As another example, the specification of British Pat. No. 992,317 discloses a similar process wherein a temperature of from 800° to 1,100° C is used in a selective chloridization reaction in a fluidized bed type chloridization furnace. In still another example, the specification of U.S. Pat. No. 2,184,885 discloses the admixing of carbon in a quantity of from 1 to 12 percent by weight relative to the ore and a reaction temperature of from 700° to 1,150° C. Furthermore, the specification of U.S. Pat. No. 2,933,373 specifies, similarly, a carbon quantity of from 20 to 30 percent and a reaction temperature of 1,050° C. On one hand, the specification of Japanese Patent Laid Open No. 2657/1971 discloses a process which comprises taking out ore which has partly undergone a chloridization reaction from a fluidized bed type chloridization furnace, cooling this ore in a reducing atmosphere such as carbon monoxide or methane, and subjecting this ore to magnetic separation thereby to separate it into a $TiO_2$ portion containing substantially no iron and a portion containing iron.

In each of the above enumerated patents and patent application, an object of the invention is to provide a process for chlorine treatment of titaniferous ores in which the iron oxides within the ore are caused to react selectively with chlorine and thereby to be removed, and the titanium content is left as a residue, the basic principle of the reaction control being the imparting of selectivity to the reaction of the chlorine relative to the iron oxides and the titanium oxide, and, at the same time, to determine the conditions for effective use of the chlorine from the standpoint of economy.

In a reducing atmosphere, however, the iron oxides and titanium oxide both react with the chlorine and respectively become iron chloride and titanium chloride, which are volatile. Accordingly, the reaction for obtaining artificial rutile from a titaniferous ore is based on the utilization of the difference between the reactivities of the iron oxides and of the titanium oxide relative to chlorine. Under ordinary conditions, however, this difference is very slight, and, as the reaction progresses from the ore outer surface toward the interior, the iron oxides in the interior remain in their unreacted state and also the titanium oxide, which is of a residue on the surface, begin to react with the chlorine, whereby the selectivity of the reaction is lost.

As measures conceived heretofore for overcoming this difficulty, there have been the practices of adjusting the quantity of the added coke in accordance with the composition of the starting material ore and the desired $TiO_2$ grade of the product and of holding the reaction temperature within a range of from 800° to 950° C. However, even when the reaction temperature is held within this range in the chlorine treatment process of the titaniferous ore wherein iron oxides are selectively chloridized, as the reaction is carried forth so as to reduce the residual iron oxide within the ore to less than 6 percent, that is, from 1 to 5 percent as in the specification of Australian Pat. No. 206,305, for example, a large quantity of $TiCl_4$ is produced. As a result, this gives rise to a loss in the titanium content, a lowering of the chlorine efficiency, and various deleterious effects on the process steps succeeding the chloridization process step.

On the other hand, the reduction of the quantity of the added coke or the carrying out of the reaction at a low temperature, as a measure for repressing the reaction of the chlorine with respect to titanium oxide, lowers the chlorine reaction efficiency and adversely affects the progress of ion-oxide removal. Moreover, a large quantity of chlorine in unreacted state passes through the chloridization furnace.

In contrast, a process wherein, by causing chlorine to react at a high temperature, e.g., 1,050° C, simultaneously in the presence of an ample quantity of a reducing agent, the chlorine reaction efficiency is maintained at a high value, and, moreover, the formation of $TiCl_4$ can be suppressed is disclosed in the aforementioned Japanese Patent Laid Open No. 2657/1971. According to this process, the ore is taken out of the chloridization furnace in state wherein iron oxides are remaining as residue in a quantity of at least 5 percent, preferably at least 10 percent, for example, 12 percent.

With a residual iron oxide quantity of 5 percent, however, $TiCl_4$ is formed, whereby a considerable quantity of titanium becomes lost as mentioned hereinabove. Accordingly, the ore is taken out of the chloridization furnace before the reaction progresses to that extent, but the ore thus taken out inevitably contains a large quantity of incompletely reacted ore. If this incompletely reacted ore is separated and repeatedly caused to undergo reaction in the chloridization furnace, a large number of cycles of the chlorine treatment of the incompletely reacted ore of large quantity mentioned above will become necessary before a $TiO_2$ product of the desired grade can be obtained, whereby the productivity of the chloridization furnace will inevitably drop. Furthermore, the loss of chlorine due to chlorine or chlorides adsorbed by or adhering to the ore taken out of the furnace unavoidably increases with increase in the quantity of ore repeatedly treated in the furnace.

SUMMARY OF THE INVENTION

It is an object of this invention to provide an economical process for chlorine treatment of titaniferous ores in which the above described difficulties accompanying the prior art are evercome, and by which artificial rutile of a desired grade can be produced as an end product as a result of selective chloridization and removal of the iron oxides within a titaniferous ore by substantially one cycle of chlorine treatment of the ore without the formation of $TiCl_4$.

According to this invention, briefly summarized, there is provided a process for producing artificial rutile of high $TiO_2$ grade which comprises, in combination, (1) a pretreatment wherein the ore is oxidation roasted at a temperature below the sintering temperature thereof thereby to activate this ore, and (a) a chloridization step wherein the ore thus pretreated is treated in a fluidized bed chloridization furnace thereby to chloridize and remove selectively iron oxides within the ore without the formation of $TiCl_4$.

According to this invention in another aspect thereof, the ore thus treated in the above described chloridation step is further subjected to an aftertreatment which comprises subjecting the ore to magnetic separation with a magnetic field of at least 20,000 gauses and, when necessary, subjecting the resulting ore to further treatment such as a wet table treatment and electrostatic separation.

The nature, further features, and utility of the invention will be apparent from the following detailed description, beginning with a consideration of general aspects of the invention and concluding with specific examples of practice illustrating preferred embodiments thereof.

BRIEF DESCRIPTION OF THE ILLUSTRATIONS

In the illustrations:

| | |
|---|---|
| Target: | Copper |
| Filter: | Nickel |
| Voltage: | 30KVP |
| Current: | 20 milliamperes |
| Count Full Scale: | $4 \times 10^2$ counts/second |
| Time Constant: | 1 second |
| Scanning Speed: | 20/minute |
| Chart speed: | 2 cm/minute |
| Divergency: | 1 degree |
| Receiving slit: | 0.2 mm |
| Glancing Angle: | 5 to 75 degrees |

and

Figure 3:
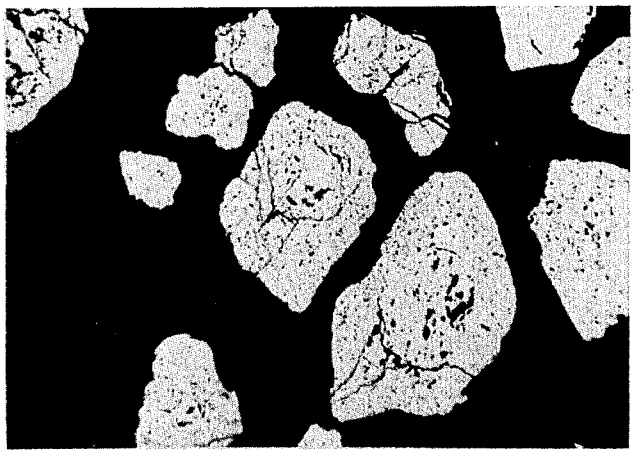

FIG. 3 is photomicrograph of a magnification of 40X showing a state during roasting in air at 950° C of a titaniferous ore obtained in Malaysia.

DETAILED DESCRIPTION

Figure 1:
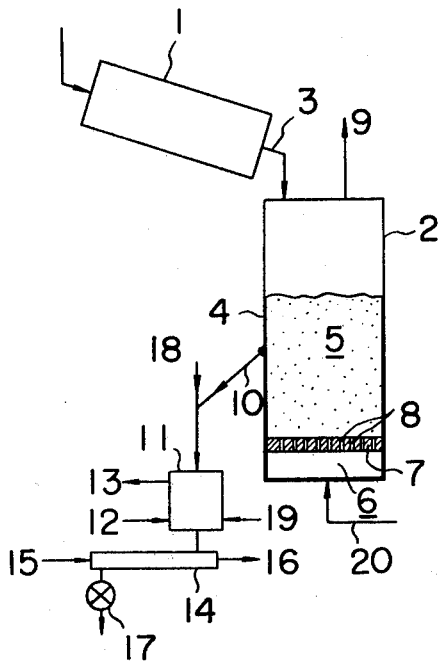
FIG. 1 is a partial flow diagram indicating an example of arrangement of apparatus suitable for use in the practice of this invention.

In the example of apparatus for practicing this invention illustrated in FIG. 1, the essential components are: a roasting furnace 1; a chloridization furnace 2 supplied with ore from the roasting furnace 1 through an ore supply inlet 3; an ore receiving vessel 11 receiving ore from the chloridization furance 2 through an ore extraction pipe 10 and a nitrogen supply inlet 18; a screw conveyor 14; and a rotary valve 17.

The chloridization furnace 2 is supplied with coke through a coke charging inlet 4 and with chlorine through a chlorine supply inlet 20 and contains a fluidized bed 5 of ore above a dispersion plate 7 having a plurality of dispersion nozzles 8 and disposed above and defining the ceiling of a draft box 6. The chloridization furnace 2 is further provided with a vent pipe 9 for discharging gases formed by the reaction.

The ore receiving vessel 11 is provided with a cooling water inlet 12, a cooling water outlet 13, and another nitrogen supply inlet 19 and discharges the treated ore by the way of the screw conveyor 14 cooled by water introduced through a cooling water inlet 15 and discharged through a cooling water outlet 16 and by way of the rotary valve 17.

A first major feature of this invention, not passed by hitherto known processes, resides in a pretreatment which is carried out prior to the chloridization step and comprises a heat treatment of the titaniferous ore (hereinafter referred to simply as "the ore") to activate the ore. This pretreatment constitutes the most important feature and part of this invention.

More specifically, in this pretreatment step, the starting ore is heat treated and thereby activated in air or an oxygen-containing atmosphere at a temperature below the sintering temperature of the ore, preferably from 800° to 1,050° C. By this pretreatment, the iron oxides not only on the outer surface of the ore but also throughout the ore to its central part react preferentially with the chlorine in the succeeding chloridization step, and selectivity is imparted to the reaction of the chlorine with respect to the ore as though the titanium oxide, relatively, is inactive with respect to chlorine and remains in the residue.

The roasting furnace 1 used in this pretreatment step is not limited to any special type, being of general type for solid-gas reactions such as a rotary-kiln type or a fluidized bed type. Furthermore, the operations of heating, supplying, and discharging the ore may be continuous or intermittent. I have found that, when the ore is roasted in air or an oxygen-containing atmosphere at a temperature below the sintering temperature of the ore, preferably from 800° to 1,050° C, for a period of from 20 to 120 minutes, preferably from 30 to 60 minutes, microscopically fine cracks are formed from the outer surface toward the interior of the ore in addition to the cracks existing prior to the roasting, and at the same time, a large number of minute voids are formed in the interior of the ore. I have found further that, at the same time, two molecules of divalent iron existing in the ore is oxidized into one molecule of trivalent ion by this roasting as indicated by the following formula, and as a result, a change occurs in the crystalline structure.

$$2FeO \cdot TiO_2 + \frac{1}{2} O_2 = Fe_2O_3 \cdot TiO_2 + TiO_2$$

The combined effect of the formation of the above described fine cracks and microvoids and the change in the crystalline structure of the ore results in the activation of the ore due to the roasting of this pretreatment step. This activation of the ore facilitates the infiltration of the chlorine into the interior of the ore during the reaction of the succeeding chloridization step and, moreover, affords selective chloridization of the iron oxides with the chlorine.

Accordingly, carrying out the roasting at a temperature above the sintering temperature is not desirable since this causes the open fine cracks and/or microvoids on the outer surface of the ore to become closed, whereby the ore loses its activated state. As long as this closing of the fine cracks and/or microvoids does not occur, a temporary rise in the ore temperature within the roasting furnace up to 1,100° C or an even higher temperature will not give rise to any problem. Furthermore, the atmosphere within the roasting furnace for heating the ore may be an oxygen-containing atmosphere other than air provided that the partial pressure of the oxygen is sufficient for oxidizing the ferrous oxide within the ore into the ferric oxide.

While the ore roasting time depends on the ore particle size, the roasting temperature, and the construction of the roasting furnace, it is desirable that this roasting time be sufficient for the formation of the above mentioned fine cracks and microvoids to reach the innermost parts of the ore. One guide or criterion for this time is that it is sufficient to cause the quantity of the divalent iron remaining within the ore after roasting to be less than 5 percent, preferably less than 1 percent by weight.

A second major feature of this invention resides in the operation conditions in the chloridization furnace. While a fluidized type chloridization furnace 2 is used for the chloridization step, the ore which has undergone the above described pretreatment is supplied from the roasting furnace 1 directly or by way of an intermediate vessel continuously or intermittently to the chloridization furnace 2. It is possible, if desired, that, during this transfer of the ore, the temperature of this ore which has been heated to the pretreatment temperature be maintained so as to sustain the heat balance within the chloridization furnace.

For the reducing agent required in the reaction, solid carbon of a particle size such that, in a fluid state, it will not segregate in the ore bed but will retain its uniformly mixed state is used. Example of preferred carbons are calcined petroleum coke and coal coke containing little ash and other impurities. This solid carbon is charged into the chloridization furnace 2 through the ore supply inlet 3 or through a separately provided charging inlet 4 in a quantity up to 10 percent, preferably from 6 to 8 percent, by weight relative to the ore.

The stationary height of the fluidized bed 5 of ore bed within the chloridization furnace 2 is maintained less than 2,500 mm., preferably between 800 and 2,500 mm., being varied in accordance with the quantity of ore treated per unit time, i.e., the ore throughput. That is, when the operation is carried out with a large throughput, the ore bed height within the furnace 2 is made large in order to cause the average residence time of the ore within the furnace to be substantially the same as that when the height is small.

The average residence time of the ore within the furnace is from 200 to 400 minutes, preferably from 250 to 300 minutes. It has been found that when this average residence time of the ore exceeds 400 minutes, $TiCl_4$ tends to be formed, and when this average residence time is less than 200 minutes, the removal of iron does not progress satisfactorily, and an appreciable quantity of iron remains in the ore discharged from of this furnace. The most suitable average residence time varies somewhat within the above stated range depending on the kind and particle size of the ore and on the chlorine reaction rate and is determined by the adjustment of the total iron, which is the sum of the residual iron oxides in the ore taken out of the chloridization furnace and the iron chloride adhering to or adsorbed on the same ore, to a value less than 5 percent, preferably less than 4 percent.

The chlorine required for the reaction is introduced into the chloridization furnace 2 through the chlorine supply inlet 20 and into the draft box 6 and is then blown into the furnace interior through the dispersion nozzles 8 of the dispersion plate 7. This chlorine is thus blown into the furnace 2 at a rate, relative to the rate of charging of the ore into the furnace, which is of a value from the theoretically required rate to a rate 15 percent in excess thereof, preferably at a rate from 5 to 10 percent in excess of the theoretically required rate. This theoretically required rate is based on the assumption that, except for the iron oxides remaining in the ore taken out of the furnace 2 per unit time, all of the other iron oxides contained in the ore originally charged into the furnace are converted into $FeCl_3$ within the furnace. The ore in the furnace is thus rendered fluid. In the case where the chlorine used has been recovered from iron chloride, it may contain less than 10 percent, ordinarily less than 5 percent of $CO_2$, it is not necessary to blow in nitrogen or other fluidity promoting gas for increasing the fluidity of the ore in the furnace.

A third major feature of this invention relates to the fluidity of the materials within the chloridization furnace 2. More specifically, instead of using nitrogen or some other fluidity promoting gas for imparting high fluidity in the chloridization step, the pressure drop across the dispersion plate 7 is caused to be rather high, for example, from 1,500 to 5,000 mm., preferably from 2,000 to 4,000 mm. of water (column) thereby to obtain a uniform dispersion of the chlorine as a fluid medium passing through the nozzles 8 of the dispersion plate 7. Moreover, the chlorine thus blown in from the exit ends of the nozzles 8 is caused to disperse into the ore bed without the formation of bubbles in a region between the upper surface of the dispersion plate 7 and a level of at least 20 mm., ordinarily at least 30 mm., thereabove, the chlorine being thus blown with a velocity ample for sustaining a uniform solid-gas state, whereby a high chlorine reaction efficiency is maintained.

In this operation, the height of the ore bed within the furnace 2 is from 800 to 2,500 mm. Accordingly, when the height is made specially large, the pressure of the chlorine blown in through the bottom of the furnace may rise to from 8,000 to 9,000 mm. of water column, but this pressure does not entail any technical problems since it is a pressure easily imparted to gaseous chlorine by adjustment of a liquid chlorine evaporator. Furthermore, when the ore layer height is made large, growth of the bubbles during passage through the fluidized bed is unavoidable, but a drop in the chlorine reaction efficiency does not arise since the time of contact of the gas with the ore is prolonged. While a high chlorine reaction efficiency is desirable, unreacted chlorine does not necessarily become a loss since even if a portion of the chlorine in unreacted state passes through the fluidized bed, it goes in that state to a chlorine recovery process.

The reaction temperature in the chloridization furnace 2 is above 800° C, preferably from 950° to 1,100° C and the average residence time of the ore with furnace is from 200 to 400 minutes, preferably from 250 to 350 minutes. Although the reaction is carried out under the conditions of this high temperature and this relatively long residence time, the preferential chlorination of iron is attained with a high chlorine reaction efficiency, and the formation of $TiCl_4$ is substantially suppressed. Such an efficient reaction is made possible by the effect of the aforedescribed pretreatment step, that is, the activation of the ore. Reaction gases ($FeCl_3$, $CO_2$, and a small quantity of CO) formed within the chloridization furnace 2, a small quantity of nitrogen for purging, and, in some cases, a very small quantity of unreacted chlorine gas are discharged through the vent pipe at the upper end of the furnace 2 to be sent to a chlorine recovery process (not shown).

A fourth major feature of this invention relates to the method of discharging the ore from the chloridization furnace. In accordance with this invention, the overflow method of discharging the ore, which is generally used with a fluidized bed reaction furnace, is not used, but rather an ore discharging outlet communicating with the upstream end of the aforementioned ore discharging pipe 10 is provided at a position below the upper surface of the fluidized bed 5. Moreover, at or above the position where the temperature of the chlorine blown through the dispersion plate 7 rising through the ore bed reaches the temperature of the ore within the furnace.

Ordinarily, the position of this ore discharging outlet is within a range of approximately from 400 mm. to 900 mm. above the dispersion plate 7 and is adjusted in accordance with the height of the ore bed. By this provision, the ore thus discharged is cleaned by the chlorine rising from below within the furnace, whereby the quantity of iron chloride adhering to or adsorbed on the discharged ore is reduced. As a result, clogging of the ore discharging pipe 10 due to solidification of iron chloride within this pipe can be prevented.

The ore thus discharged through the pipe 10 is cooled in the ore receiving vessel 11. The ore thus cooled is then metered and delivered at a specific rate by a screw conveyor 14 through the rotary valve 17, thereby being taken out. At an intermediate point in the pipe 10 and/or at the ore receiving vessel 11, an inert gas supplying inlet 18 and/or an inert gas supplying inlet 19 are or is provided, as described hereinbefore, to supply a small quantity of an inert gas, e.g., nitrogen gas, toward the furnace 2 thereby to promote further the recovery of chlorine content such as the chlorine or iron chloride adhering to or adsorbed on the discharged ore and the prevention of clogging of the pipe 10.

A fifth major feature of this invention relates to an aftertreatment of the ore taken out of the chloridization furnace 2. This aftertreatment according to the invention is an appropriate combination of magnetic separation, wet table, i.e. a Wilfley table and electrostatic separation carried out for the purpose of separating partially incompletely reacted ore, solid carbon, chlorides, and gangue minerals which are extra constitutents still admixed in the ore discharged from the chloridization furnace 2 and producing artificial rutile as the final product.

In this aftertreatment, the ore discharged from the chloridization furnace is first subjected to a magnetic separation in a magnetic field of at least 20,000 gausses, preferably from 25,000 to 30,000 gausses. Here, the magnetic separation is made possible by a slight difference between the susceptibility of a paramagnetic substance such as hematite ($Fe_2O_3$) or pseudobrookite ($Fe_2TiO_5$) of an unreacted nucleus remaining in the central part of the incompletely reacted ore and the susceptibility of the completely reacted ore of a composition represented by rutile in a strong magnetic field. An ore of incompletely reacted having a residual iron content passes through a magnetic separator and should freely ball under the influence of gravity, but during the fall its path is deflected toward a magnetic pole according to the residual iron content, whereby the ore is separated from the completely reacted ore falling vertically. That the substance remaining as an unreacted nucleus in the incompletely reacted ore is hematite or pseudobrookite has been verified with X rays. This hematite or pseudobrookite of the unreacted nucleus was originally present in the same form as that in the titaniferous ore or has been produced in the roasting step.

While there is no particular restriction on the kind of magnetic separator employed, a magnetic separator of coupled pole type is most suitable since the ore having the unreacted nucleus is separated by the bending of its path of free fall as described above. With a Wetherill type magnetic separator, the separation is not sufficient, even with a strong magnetic field, and particularly when the reaction progresses and the unreacted nucleus becomes small, separation becomes impossible, whereby an artificial rutile product of high grade connot be obtained. A coupled pole type magnetic separator separates the particles ore having a small unreacted nucleus as an intermediate of a weakly magnetic part between a magnetic part and a nonmagnetic part. The average $TiO_2$ and residual Fe contents of these three parts are indicated in Table 1.

Table 1

$TiO_2$ and residual Fe contents of each part separated by magnetic separation

| PART | $TiO_2$ (%) | Total Fe (%) |
|---|---|---|
| Magnetic part | 70 – 75 | 11 – 16 |
| Weakly magnetic part | 75 – 80 | 4 – 5 |
| Non-magnetic part | 80 – 93 | 1 |

The magnetic part is retreated in the chloridization furnace independently or as a mixture of the newly charged ore. While the weakly magnetic part, by itself or as a mixture with the non-magnetic part, can be used as the product, it is ordinarily mixed with the magnetic part and retreated in the chloridization furnace.

While the iron content remaining in the non-magnetic part is less than 1 percent as Fe, the $TiO_2$ content remains at from 80 to 93 percent since the solid carbon remaining after the chloridization reaction concentrates in the non-magnetic part. Accordingly, if the solid carbon is removed, the $TiO_2$ content will be 95 percent or higher, but as a starting material for producing $TiCl_4$, the admixture of solid carbon does not give rise to any problem and can be rendered directly into a product as a $TiO_2$ enriched ore.

However, in the case where an even higher grade is required for the product as artificial rutile, a process wherein solid carbon is separated through the use of a combination of a wet-type table such as a Wilfley table and an electrostatic separater, and electrostatic separation is carried out further to separate gangue materials such as silica and alumina is adopted. More specifically, the solid carbon, e.g., calcined petroleum coke is used in a particle size of less than 20 mesh (Tyler standard sieve), but since it reacts and is consumed and becomes finely pulverized, the calcined petroleum coke accompanying the ore discharged from the chloridization furnace has a wide distribution of particle size. This coke, moreover, has various substances which adhere thereto or are adsorbed thereon in the chloridization process.

Accordingly, a first aim in using the above mentioned wet-type table is to wash off the finely pulverized solid carbon, ash, or some other substance in the form of a fine powder adhering to the above mentioned non-magnetic ore by light attrition on the table. A second aim is to dissolve and remove the chlorides, principally iron chloride, adhering to or adsorbed on the above mentioned non-magnetic ore and solid carbon. A third aim is to separate the above mentioned non-magnetic ore from the solid carbon by means of water flowing in a manner such that the non-magnetic ore itself does not flow or flows at a speed differing from that of the solid carbon.

The apparatus for achieving these aims is not necessarily limited to only a table such as a Wilfley table, it being possible also to carry out the ore treatment on a plate vibrating gently in a current of water or a fluid leaching process. As the case may be, the separation of said carbon by means of a wet type table is not thorough, and a residual solid carbon content of from 1 to 2 percent by weight remains, depending on the difference of particle sizes distribution of coke relation to those of the ore.

In the case abovementioned this residual solid carbon of from 1 to 2 percent can be separated by passing the ore, after it has been dried, through an electrostatic separator operating with a voltage of from 5,000 to 12,000 volts. In this process, the solid carbon is electrically conductive whereby when it is subjected to the treatment in the electrostatic separator under the voltage of from 5,000 to 12,000 volts, it is readily thrown from the poles. However, solid carbon in the form of fine particles has an insufficient flight path and cannot be thoroughly separated from the ore. Furthermore, ore which has not undergone a process of washing with water gives rises a further complication of the conditions of electrostatic separation because of the influence of adsorption of substances thereon. As a consequence, the separation of the residual solid carbon only by the electrostatic separation is not thorough, similarly as in the case of the wet type, i.e. Wiefley table table only.

Accordingly, it is desirable in this case to separate the solid carbon by using a combination of a wet type table and an electrostatic separator, removing fine particles of coke with the wet type table and removing coarse particles relatively close to that of the ore with the electrostatic separator.

The ore from which the solid carbon has been thus separated can be further treated means of an electrostatic separator operated within a range of from 12,000 to 30,000 volts, whereupon gangue minerals containing silica, alumina, and the like as principal constituents are separated as a non-conductive substance from the conductive, $TiO_2$ enriched ore. The ore discharged from the chloridization furnace undergoes a part of or the entire aftertreatment described above to become the final product, that is the artificial rutile of a $TiO_2$ grade of 95 percent or higher.

The noteworthy features of advantage and usefulness of the invention, as are apparent from the foregoing detailed description, can be summarized as follows. 1. The pretreatment for the original starting ore imparts a change to the crystalline structure of the ore and, at the same time, gives rise to the formation of fine cracks and microvoids throughout the ore even to the innermost parts thereof thereby activating the ore and facilitating the infiltration of chlorine into the interior of the ore particles. At the same time, the iron oxides within this ore react readily and preferentially with the chlorine with the result that the reaction between the chloride and titanium oxide is relatively suppressed, whereby this pretreatment has the effect of imparting reaction selectivity to the chlorine.

2. As a result, in the chloridization furnace, the greater part of the iron oxides within the ore is selectively chloridized and removed with substantially no formation of $TiCl_4$ whereby it is possible to keep the total Fe of the residual iron oxides in the ore discharged from the chloridization furnace and the iron chloride adhering to or adsorbed on this ore below 5 percent, ordinarily below 4 percent.

3. Accordingly, the greater part of the original ore becomes a product with only a single cycle of chloridization treatment, and only a small quantity of incompletely reacted are requires retreatment by chloridization.

4. That the ore requiring retreatment is of small quantity means that the productivity of the chloridization furnace is high. Furthermore, the small quantity of the ore requiring retreatment also means that the loss of chlorine or chloride due to adhesion or adsorption the ore discharged from the chloridization furnace is less.

5. The fluidity of the ore bed in the chloridization furnace is sustained by providing a large drop across the dispersion plate 7 and by adjusting the velocity at which the chlorine is injected through the nozzles 8 of the dispersion plate, and additional fluidizing gases such as nitrogen for the establishment of turbulency of fluidization is not resorted to. Accordingly, there is no dilution of the exhaust gases in the reaction due to such gas as nitrogen, which may therefore advantageous in view of chlorine recovering by the treatment of the exhaust gas.

6. An inherent characteristic of an ordinary fluidized bed reaction furnace is that its reaction efficiency rapidly and unavoidably decreases more or less as the furnace size is increased. In the chloridization furnace according to this invention, however, the fluidized state of one is relatively mild and steady because of the no using of extra gas but only chlorine as described above, whereby scaling up has little effect on the chlorine reaction efficiency, and the results of using a large furnace are similar to those of a pilot furnace.

7. Because of the above-mentioned relatively mild state of the fluidized bed according to this invention, there is little pulverization of the fluidizing particles due to mutual attrition and little effect on errosion of the furnace wall bricks so that the loss of the ore and solid carbon due to carry-over is small.

8. In the discharging of the ore by the so-called overflow method generally adopted in fluidized bed reaction furnaces, the ore is discharged at a position where the concentration of iron chloride vapor formed by the reaction is a maximum. For this reason, the iron chloride swept out together with the discharged ore not only solidifies to cause clogging of the ore discharging pipe but also causes chlorine loss.

In accordance with this invention, the ore extraction outlet is provided at a position which is at or above the position where the chlorine blown into the furnace through the bottom thereof absorbs heat from the surrounding material, and its temperature reaches the same temperature of the ore within the furnace, this position being below the upper surface of the fluidized ore bed. The ore thus discharged is cleaned by the chlorine rising within the furnace from the bottom thereof. Furthermore, by introducing a small quantity of nitrogen into an intermediate part of the ore discharging outlet pipe or from the ore receiving vessel 11 and causing the same to flow toward the chloridization furnace, any chlorine adhering to or adsorbed on the discharged ore can cleaned off and removed. This double cleaning action results in effective prevention of chlorine loss and of clogging of the ore discharging mechanism.

9. The residual iron oxides within the discharged are are unavoidably admixed with a small fraction of ore into the furnace as a natural consequence of oxidation the nature of a fluidized bed operation. However, since this incompletely reacted ore can be magnetically separated, there is no necessity for carrying out the reaction beyond the limit of selective chloridization, whereby the operation of the chloridization furnace is facilitated.

10. As the iron remaining in the incompletely reacted ore separated by magnetic separation is hematite or pseudobrookite, this ore can be retreated in the chloridation furnace without subjecting it again to a pretreatment of roasting.

11. The non-magnetic fraction resulting from the magnetic separation contains a small quantity of residual chlorides, principally iron chloride, which can be removed by treatment by means of a Wilfley table or the like, whereby various difficulties, such as unsteady condition in the electrostatic separation and corrosion of vessels or apparatus, due to the hygroscopic property of the iron (ferric) chlorides in the succeeding process steps can be eliminated.

12. The coke separated by the combination of the wet-type, e.g. Wilfley, table and the electrostatic separator is reused, whereby a saving in coke requirement can be made.

13. The separation of the gangue mineral constituents such as silica and alumina by the electrostatic separator has the effect, when the artificial rutile is used as a starting material for producing $TiCl_4$, of facilitating the prevention of chlorine loss, of purification of raw $TiCl_4$ and of simplifying the $TiCl_4$ production process by reducing the quantity of the reaction residue.

As is apparent from the foregoing description, this invention provides a process for chlorine treatment of a titaniferrous ore wherein, by a combination of (1) a pretreatment step which comprises oxidation roasting the ore at a temperature lower than the sintering temperature thereof thereby to activate the same, (2) a chloridization step which comprises chloridizing by means of a fluidized bed chloridization furnace the ore thus pretreated thereby to chloridize and remove preferentially iron oxides within the ore without the formation of $TiCl_4$, and (3) aftertreatment steps which comprises subjecting the ore after the chloridization step to magnetic separation, wet-type, e.g. Wilfley table treatment, and electrostatic separation thereby to upgrade the $TiO_2$ content of the product, artificial rutile of a $TiO_2$ content of more than 95 percent can be economically produced as a final product with substantially single cycle of chloridization treatment.

In order to indicate more fully the nature and utility of this invention, the following specific examples of practice constituting preferred embodiments of the invention are set forth, it being understood that these examples are presented as illustrative only and that they are not intended to limit the scope of the invention.

EXAMPLE 1

An ore obtained in Australia and containing 53.4% of $TiO_2$, 20.4% of FeO, 19.8% of $Fe_2O_3$, 1.63% of MnO, 1.68% of $SiO_2$, 1.41% of $Al_2O_3$, and a small quantity of other impurities was continuously charged at a rate of 1.5 kg/minute into one end of a rotary kiln used as an oxidation roasting furnace. This rotary kiln had an inner diameter of 350 mm., a length of 4.5 meters, and an axial inclination angle of 3° and was rotated at a speed of 1.2 revolutions per minute.

City gas was used as fuel to heat the ore so that a zone within this furnace at a temperature above 900° C and at the most 1,050° C extended approximately 1.5 meters in the longitudinal direction of the furnace. Under these conditions, the ore oxidation was roasted until the residual $Fe^{2+}$therewithin became from 0.4 to 0.6 percent, and thereafter the ore was discharged continuously from the other end of the furnace.

This roaster ore, in a red-hot state was immediately charged continuously into a fluidized bed chloridization furnace of 400-millimeter internal diameter through an ore charging inlet at the upper end thereof. Through a separate charging inlet of this furnace, calcined petroleum coke in particulate form less than 20-mesh size as measured by a standard Tyler sieve was continuously charged at a rate of 120 grams/minute (corresponds to 8% of the ore). A quantity of 250 kg of the ore of a static bed height of approximately 1,000 mm. was retained within the chloridization furnace. Chlorine was blown into the ore bed through a dispersion plate installed at the bottom of the furnace at a flowrate of 260 liters/minute (at atmospheric pressure and room temperature) with the aim of maintaining a total Fe residue remaining in the ore taken out of this furnace at 4%.

The pressure drop across the dispersion plate was approximately 3,000 mm. of water column. An ore extraction pipe was connected at a position 450 mm. above the dispersion plate. The reaction temperature in the chloridization furnace as 950° C. The gases produced by the reaction were exhausted through a vent pipe at the upper end of the furnace to a chlorine recovery process (not mentioned).

At an intermediate point in the ore dischargng pipe, nitrogen was blown into the pipe at a flowrate of 2 liters/minute to prevent clogging of this pipe. The ore discharged from the chloridization furnace was cooled in the water-cooling tubes and water-cooled walls within an ore receiving vessel and then transferred at a rate of 900 grams/minute from a screw conveyor and then discharged through a rotary valve provided at the downstream end of the screw conveyor for pressure sealing the chloridization furnace. The average residence time of the ore within the chloridization furnace was approximately 280 minutes.

As a result, the composition of the ore discharged from the chloridization furnace and the composition of the ore after the incompletely reacted ore part having an unreacted nucleus was separated by means of a coupled pole magnetic separator operated with a pole gap of 3 mm., a magnetic field strength of 27,000 gausses, and a pole rotational speed of 70 rpm. were as set forth in Table 2.

Table 2

| Kind of ore | Compositions of ore as discharged from chloridization furnace and after magnetic separation | | | | | | |
|---|---|---|---|---|---|---|---|
| | Percent by weight | $TiO_2$ | | Total Fe | | Coke | |
| | | Content (%) | Distribution (%) | Content (%) | Distribution (%) | Content (%) | Distribution (%) |
| Discharged ore | 100 | 86.13 | 100 | 3.92 | 100 | 5.1 | 100 |
| Magnetic part | 9.3 | 72.56 | 7.8 | 15.8 | 37.6 | 0.6 | 1.1 |
| Weakly magnetic part | 13.5 | 78.64 | 12.3 | 13.7 | 47.4 | 1.3 | 3.3 |
| Non-magnetic part | 77.2 | 89.09 | 79.9 | 0.7 | 15.0 | 6.2 | 95.6 |

Figure 2:
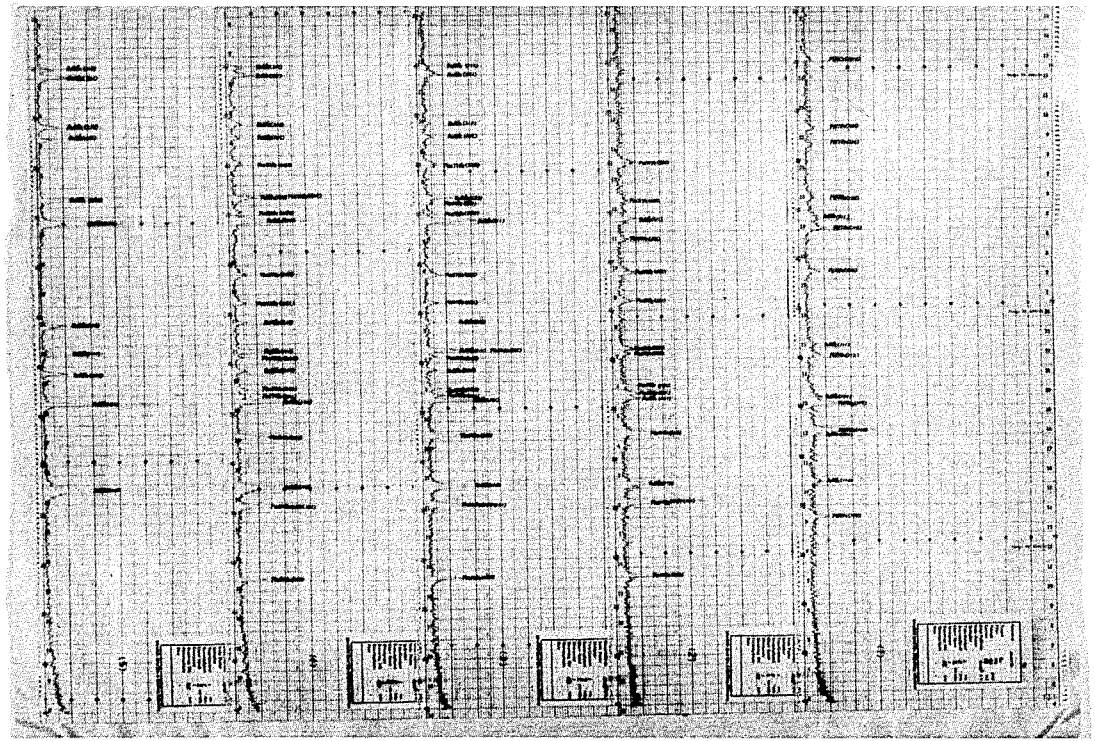
FIG. 2 is a group of five X-ray photographs of a titanium-containing iron-oxide ore obtained in Australia and selectively separated after a pretreatment process step and a chloridization step wherein the particulars are as follows.

The separated ore parts indicated above and ore before and after oxidation roasting, for reference, were subjected to X rays, whereupon the X-ray photographs 1 through 5 in FIG. 2 were obtained and indicated that the iron content remaining in the unreacted nucleus of the incompletely reacted ore is pseudobrookite ($Fe_2TiO_5$).

Next, the above mentioned non-magnetic part was treated by means of Wilfley table, whereupon the results indicated in Table 3 were obtained. The table concentrate was subjected to treatment in an electrostatic separator operated at 10,000 volts, and coke was separated, whereupon the results shown in Table 4 were obtained.

Table 3

| Kind of ore | Coke separation by Wilfley table | | |
|---|---|---|---|
| | $TiO_2$ (%) | Total Fe (%) | Coke |
| Supplied ore | 89.09 | 0.76 | 6.2 |
| Concentrate | 95.27 | 0.51 | 1.9 |
| Middling | 60.30 | 0.57 | 7.4 |
| Tailing | 0.41 | 0.88 | 79.3 |

Table 4

| Kind of ore | Coke separation by electrostatic separation of table concentrate | | |
|---|---|---|---|
| | $TiO_2$ (%) | $Fe_2O_3$ (%) | Coke |
| Supplied ore | 95.27 | 0.51 | 1.9 |
| Conductor | 34.61 | 0.57 | 58.7 |
| Non-conductor | 96.33 | 0.49 | 0.8 |

Finally, the above mentioned non-conductor separated by the electrostatic separator was subjected again to electrostatic separation at 22,000 volts, whereupon a gangue mineral containing predominantly silica and alumina was separated. As the final product, an artificial rutile of very high $TiO_2$ grade as indicated in Table 5 was obtained.

Table 5

| Constituent | Composition of artificial rutile | | | | | | | |
|---|---|---|---|---|---|---|---|---|
| | $TiO_2$ | $Fe_2O_3$ | MnO | $SiO_2$ | $Al_2O_3$ | $P_2O_5$ | $V_2O_5$ | $ZrO_2$ |
| Percent by weight | 96.84 | 0.35 | 0.08 | 0.18 | 0.75 | 0.004 | 0.01 | 0.02 |

EXAMPLE 2

An ore obtained in Malaysia and containing 53.1% of $TiO_2$, 27.9% of FeO, 10.6% of $Fe_2O_3$, 3.74% of MnO, 2.40% of $SiO_2$, 1.28% of $Al_2O_3$, and other impurities was heated to 950° C in a fluidized roasting furnace with air as the fluidizing medium. The ore was taken out of this furnace after an average residence time therein of 40 minutes and, in that state, was charged directly into a fluidized bed chloridization furnace at a rate of 1 kg/minute. The activated state of this ore after it is heated in air to 950° C is shown in the photomicrograph of FIG. 3.

The same fluidized bed chloridization furnace specified in Example 1 was used, and the same kind of coke as that used in Example 1 was charged through the same charging inlet in a quantity of 10 percent relative to the ore. The reaction temperature was 1,000° C. Chlorine was blown into the ore bed through the furnace bottom at a flowrate of 110 percent of the theoretical quantity, that is 190 liter/minute (at atmospheric pressure and room temperature) with the aim of maintaining a total Fe residue remaining in the extracted ore at 5%. The quantity of the ore within the furnace was 200 kg., and the corresponding static bed height was approximately 800 mm. The average residence time of the ore within the furnace was approximately 330 minutes. The reason for this average residence time being longer than that in Example 1 is that the particle size of this Malaysian ore is greater as indicated in Table 6.

Table 6

| Comparison of ore particle sizes | | | |
|---|---|---|---|
| Malaysian ore | | Australian ore | |
| Mesh size, Tyler standard sieve | Percent by weight | Mesh size, Tyler standard sieve | Percent by weight |
| +28 | 0.6 | +48 | 1.0 |
| −28 − +35 | 2.8 | −48 − +60 | 3.6 |
| −35 − +48 | 24.0 | −60 − +80 | 30.2 |
| −48 − +100 | 66.6 | −80 − +100 | 12.9 |
| −100 − +150 | 4.9 | −100 − +120 | 38.8 |
| −150 | 1.1 | −120 | 13.7 |

The ore discharged from the chloridization furnace was treated by means of the magnetic separator specified in Example 1 operated with a pole gap of 3 mm., a magnetic field strength of 23,000 gausses, and a pole rotational speed of 70 rpm. As a result of separation of incompletely reacted ore admixed in the reacted ore, a magnetic part, a weakly magnetic, and non-magnetic part were obtained as indicated in Table 7.

Table 7

| Magnetic separation of Malysian ore | $TiO_2$ (%) | Total residual Fe (%) |
|---|---|---|
| Magnetic part | 70.1 | 17.1 |
| Weakly magnetic part | 82.4 | 6.30 |
| Non-magnetic part | 92.5 | 0.67 |

The non-magnetic part thus obtained may be used directly as a product. In the instant example, in order to elevate the $TiO_2$ content by further separation, this non-magnetic part was washed by a fluid leaching method with water rising at a superficial linear velocity of 1 cm/second, and, simultaneously separation of coke was carried out. As a result, a soluble iron salt corresponding to 0.2 percent as Fe was removed, and, furthermore, 1.6 percent of coke was removed from the non-magnetic part above-mentioned which contained 4.4 percent of coke, 2.8 percent of the coke remaining.

Then, after this ore was dried in a dryer, it was subjected to separation of coke by electrostatic separation with 10,000 volts. The $TiO_2$ content and distribution of the resulting product and products resulting from further electrostatic separation at differrent voltages are set forth in Table 8.

Table 8

| Results of electrostatic separation of non-magnetic part | | | | |
|---|---|---|---|---|
| Voltage | Percent by weight | $TiO_2$ Grade (%) | $TiO_2$ distribution (%) | Remarks |
| Supplied ore | 100 | 92.51 | 100 | Separation of Coke |
| Conductor at 10,000V | 2.25 | 26.44 | 0.64 | |
| Conductor at 14,000V | 60.84 | 95.60 | 62.87 | |
| Conductor at 18,000V | 16.00 | 96.01 | 16.61 | |
| Conductor at 25,000V | 15.26 | 96.81 | 15.97 | |
| Intermediate + non-conductor at 25,000V | 5.65 | 59.88 | 3.66 | Gangue minerals such as silica, alumina |
| 14,000 − 25,000 V conductor total | 92.10 | 95.88 | 95.45 | |

What I claim is:

1. In a process for producing artificial rutile by the chlorine treatment of a titaniferous ore wherein said ore is treated with chlorine thereby to chloridize and remove selectively therefrom iron oxides within the ore, the improvement which comprises performing in sequence:

1. a predetermined step which comprises oxidatively roasting ore in a oxygen-containing atmosphere having an oxygen partial pressure sufficient for converting $Fe^{2+}$in the ore to $Fe^{3+}$, at a temperature below the sintering temperature of the ore, until the residual $Fe^{2+}$within the ore becomes less than 5 percent thereby to activate the ore;
2. a chloridization step which comprises charging said ore thus activated in said pretreatment step into a fluidized bed chloridization furnace, thereby to maintain a fluidized bed of the ore therewithin, blowing chlorine into said bed through the bottom of said furnace in a quantity substantially in the range of from 100 to 115 percent of the theoretical quantity with respect to the iron oxides to be removed, and subjecting said ore to chloridization treatment in the presence of a solid reducing agent consisting essentially of carbon in a maximum quantity of 10 percent by weight of the ore, at a reaction temperature of at least 800° C, and for an average residence time of the ore in the furnace of from 200 to 400 minutes,
3. a magnetic separation step which comprises subjecting said ore thus chlorine-treated in the chloridization step to magnetic separation with a magnetic field of at least 20,000 gauss, thereby to separate the magnetic fraction of the chlorine-treated ore comprising incompletely reacted ore as the magnetic fraction from the non-magnetic fraction comprising substantially completely reacted ore and remaining carbon reducing agent,
4. a wet table treatment step which comprises subjecting the non-magnetic fraction of the ore obtained in the magnetic separation step to a stream of water and vibration to effect a differential flow rate between the particles of non-magnetic ore and remaining carbon reducing agent, thereby effecting a partial separation of the remaining carbon reducing agent from the ore of said non-magnetic fraction and
5. an electrostatic separation step which comprises subjecting ore of said non-magnetic fraction to electrostatic separation at from 5,000 to 12,000 volts, thereby recovering the still remaining carbon reducing agent and producing artificial rutile of high titanium dioxide content.

2. The process as claimed in claim 1 in which the ore thus subjected to said electrostatic separation is further subjected to electrostatic separation at from 12,000 to 30,000 volts.

3. A process as claimed in claim 1 in which said magnetic fraction separated in the magnetic separation step is recycled to said chloridization step.

4. A process as claimed in claim 1 in which the carbon reducing agent recovered in said wet table treatment step and electrostatic separation step is recycled to said chloridization step.

5. A process as claimed in claim 1 in which the artificial rutile obtained in the electrostatic separation step is further subjected to electrostatic separation, thereby to separate mineral gangue materials contained in the original ore and remaining in the artificial rutile, and produce artificial rutile of titanium dioxide content of 95% or more.

6. A process as claimed in claim 1 in which said chlorine blown into the fluidized bed through a plurality of nozzles of a dispersing plate disposed at the bottom of said chloridization furnace at such a speed that the pressure drop through the dispersing plate is from 1,500 to 5,000 mm of water, and is caused to disperse into the fluidized bed without the formation of bubbles in a region between the upper surface of the dispersing plate and a level of 20 mm thereabove.

* * * * *